US008303737B2

(12) United States Patent
Kosaka et al.

(10) Patent No.: US 8,303,737 B2
(45) Date of Patent: Nov. 6, 2012

(54) BRASS MATERIAL

(75) Inventors: Yoshiharu Kosaka, Takaoka (JP); Masanori Okuyama, Oyabe (JP)

(73) Assignee: San-Etsu Metals Co., Ltd., Takaoka-Shi (JP)

( * ) Notice: Subject to any disclaimer, the term of this patent is extended or adjusted under 35 U.S.C. 154(b) by 1183 days.

(21) Appl. No.: 11/516,034

(22) Filed: Sep. 5, 2006

(65) Prior Publication Data

US 2007/0039667 A1 Feb. 22, 2007

Related U.S. Application Data

(63) Continuation of application No. PCT/JP2005/005082, filed on Mar. 22, 2005.

(30) Foreign Application Priority Data

Mar. 29, 2004 (JP) ..... 2004-097166

(51) Int. Cl.
*C22C 9/04* (2006.01)

(52) U.S. Cl. ..... 148/433; 420/472

(58) Field of Classification Search ..... 148/433; 420/472

See application file for complete search history.

(56) References Cited

U.S. PATENT DOCUMENTS

| | | | |
|---|---|---|---|
| 5,637,160 | A | 6/1997 | Brock et al. |
| 6,599,378 | B1 | 7/2003 | Hagiwara et al. |
| 2002/0015657 | A1 | 2/2002 | Dong |
| 2003/0095887 | A1 | 5/2003 | Dong |
| 2004/0159375 | A1 | 8/2004 | Yamagishi |

FOREIGN PATENT DOCUMENTS

| | | | | |
|---|---|---|---|---|
| JP | 2000-169919 | A1 | | 6/2000 |
| JP | 2000169919 | | * | 6/2000 |
| JP | 2001-059123 | A1 | | 3/2001 |
| JP | 2001-064742 | A1 | | 3/2001 |
| JP | 2002-003967 | A1 | | 1/2002 |
| JP | 2003-247035 | A1 | | 9/2003 |
| JP | 2003-277855 | A1 | | 10/2003 |
| JP | 2004-244672 | A1 | | 9/2004 |
| JP | 2004-346947 | A1 | | 12/2004 |
| JP | 2004-359968 | A1 | | 12/2004 |

* cited by examiner

*Primary Examiner* — Sikyin Ip
(74) *Attorney, Agent, or Firm* — Burr & Brown

(57) ABSTRACT

A lead-free brass material exhibiting excellent forgeability and dezincification resistance is provided. The brass material includes 61.0 to 63.0 wt % of Cu, 0.5 to 2.5 wt % of Bi, 1.5 to 3.0 wt % of Sn, 0.02 to 0.10 wt % of Sb, and 0.04 to 0.15 wt % of P, with the balance being substantially Zn. The brass material is a lead-free, free-cutting alloy which can be suitably applied to forging and which exhibits excellent mechanical properties and dezincification resistance without substantially subjecting the brass material to a heat treatment after forging.

4 Claims, 3 Drawing Sheets

(α PHASE ETCHING; ×260)

MAXIMUM DEZINCIFICATION PORTION: 69 μm

AVERAGE DEZINCIFICATION PORTION: 20 TO 25 μm

FIG. 1

(wt%)

| Material No. | Cu | Bi | Fe | Sn | Si | P | Pb | Sb | Zn |
|---|---|---|---|---|---|---|---|---|---|
| 1 | 62.84 | 1.89 | 0.004 | 2.05 | - | 0.073 | 0.003 | 0.058 | Balance |
| 2 | 61.46 | 1.89 | 0.014 | 2.10 | - | 0.080 | 0.003 | 0.057 | Balance |
| 3 | 61.61 | 1.38 | 0.003 | 2.01 | - | 0.093 | 0.001 | 0.058 | Balance |
| 4 | 61.70 | 0.76 | 0.005 | 1.96 | - | 0.092 | 0.003 | 0.052 | Balance |
| 5 | 61.69 | 1.28 | 0.010 | 2.84 | - | 0.054 | 0.004 | 0.054 | Balance |
| 6 | 61.70 | 1.87 | 0.004 | 1.98 | 0.13 | 0.097 | 0.003 | 0.051 | Balance |
| 7 | 61.81 | 2.06 | 0.003 | 2.04 | 0.26 | 0.095 | 0.002 | 0.057 | Balance |
| 8 | 62.09 | 2.00 | 0.008 | 1.98 | 0.22 | 0.100 | 0.002 | 0.057 | Balance |
| 9 | 62.07 | 1.02 | 0.003 | 1.93 | 0.21 | 0.106 | 0.002 | 0.060 | Balance |
| Comparative Example 1 | 63.10 | - | 0.020 | 2.46 | - | 0.093 | 2.090 | 0.058 | Balance |
| Comparative Example 2 | 61.42 | - | 0.020 | 2.50 | - | 0.080 | 2.070 | 0.059 | Balance |
| Comparative Example 3 | 60.53 | 1.94 | 0.011 | 1.97 | - | 0.081 | 0.002 | 0.063 | Balance |

FIG. 2

| Material No. | Mechanical properties | | Dezincification depth | | Hot forgeability | | | | | |
|---|---|---|---|---|---|---|---|---|---|---|
| | Tensile strength | Elongation | Maximum value | Average value | Upset ratio (%) | | | | | |
| | ($N/mm^2$) | (%) | (μm) | (μm) | 40 | 50 | 60 | 70 | 80 | 90 |
| 1 | 349 | 20 | 62 | 10 | Good | Good | Bad | - | - | - |
| 2 | 350 | 20 | 69 | 20 to 25 | Good | Good | Good | - | - | - |
| 3 | 387 | 24 | 55 | 10 | - | - | Good | Good | Good | Good |
| 4 | 391 | 23 | 50 | 10 | - | - | Good | Good | Good | Good |
| 5 | 416 | 19 | 60 | 20 | - | - | Good | Good | Good | Good |
| 6 | 394 | 16 | 75 | 20 | - | - | Good | Good | Bad | - |
| 7 | 412 | 14 | 70 | 15 | - | - | Good | Good | Fair | - |
| 8 | 404 | 17 | 70 | 20 | - | - | - | Good | Bad | Bad |
| 9 | 428 | 20 | 75 | 20 | - | - | - | Good | Good | Good |
| Comparative Example 1 | 337 | 17 | - | - | Good | Fair | Bad | Bad | - | - |
| Comparative Example 2 | 383 | 14 | 150 | 30 | - | - | Good | Good | Good | Fair |
| Comparative Example 3 | 343 | 16 | 160 | 30 | - | - | Good | Good | Fair | Bad |

FIG. 3
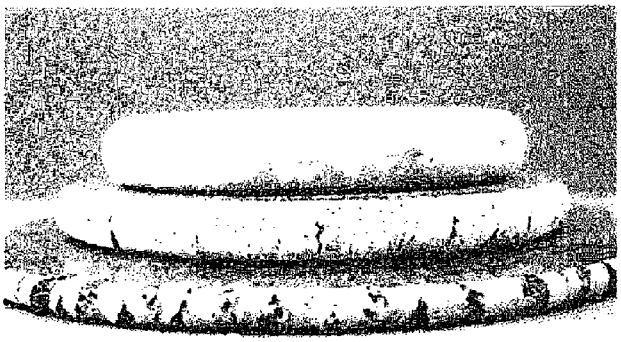
FIG. 4
(α PHASE ETCHING; ×260)
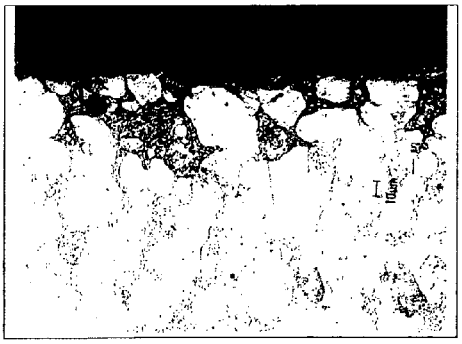
MAXIMUM DEZINCIFICATION PORTION: 69 μm
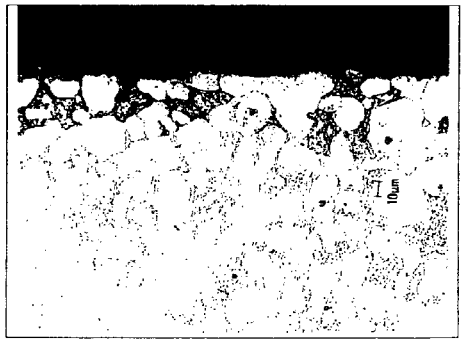
AVERAGE DEZINCIFICATION PORTION: 20 TO 25 μm

BRASS MATERIAL

CROSS REFERENCE TO RELATED APPLICATION

This application is a continuation of International Patent Application No. PCT/JP2005/005082, having an international filing date of Mar. 22, 2005, which designated the United States, the entirety of which is incorporated herein by reference. Japanese Patent Application No. 2004-97166 filed on Mar. 29, 2004 is also incorporated herein by reference in its entirety.

BACKGROUND OF THE INVENTION

The present invention relates to an extruded or drawn brass material. More particularly, the invention relates to a brass material for forging which exhibits excellent forgeability, dezincification resistance, mechanical properties, and free cutting properties.

A brass material exhibits poor hot forgeability when a specific amount of ductile beta phase is not produced during hot working.

On the other hand, when the beta phase is produced in addition to the alpha phase in the microstructure after forging, dezincification tends to occur at the beta phase.

A brass material containing only the alpha phase may be obtained by adjusting the Cu content to more than 63%. However, such a brass material cannot be applied to hot forging due to high hot resistance.

Moreover, such a brass material shows poor mechanical properties (e.g. tensile strength).

In order to deal with this problem, the beta phase may be caused to disappear by forging a brass material having a Cu content of about 61% and subjecting the forged brass material to a heat treatment.

JP-A-2000-169919 discloses a lead-free brass material having a Cu content of 60.5 to 63.5 wt % and containing Ni and Sn in order to provide the brass material with dezincification resistance, strength, and the like.

However, since this technology suffers from insufficient forgeability, the brass material must be subjected to a heat treatment or annealing in order to ensure corrosion resistance.

JP-A-2003-247035 discloses a Cu—Zn—Sn—Si-based brass material exhibiting dezincification resistance. However, this brass material exhibits insufficient hot forgeability.

SUMMARY OF THE INVENTION

In view of the above-described technical situation, the invention has an object of providing a lead-free brass material which exhibits excellent forgeability and excellent dezincification resistance without subjecting the brass material to a heat treatment after forging.

In order to achieve the above object, the present invention provides a brass material comprising 61.0 to 63.0 wt % of Cu, 0.5 to 2.5 wt % of Bi, 1.5 to 3.0 wt % of Sn, 0.02 to 0.10 wt % of Sb, and 0.04 to 0.15 wt % of P, with the balance being substantially Zn.

The brass material may comprise 61.0 to 63.0 wt % of Cu, 0.5 to 2.5 wt % of Bi, 1.5 to 3.0 wt % of Sn, 0.02 to 0.10 wt % of Sb, 0.04 to 0.15 wt % of P, and 0.05 to 0.30 wt % of Si, with the balance being substantially Zn.

If the Cu content exceeds 63.0 wt %, the hot resistance of the brass material is increased due to a decrease in the amount of beta phase during hot working, whereby a brass material suitable for hot forging may not be obtained. If the Cu content is less than 61.0 wt %, the brass material may exhibit poor dezincification resistance.

Therefore, the Cu content is preferably 61.0 to 63.0 wt %.

Bi is mainly added to provide the lead-free alloy with free cutting properties.

Bi rarely forms an alloy with Cu and Zn, but is dispersed in the microstructure to improve free cutting properties.

On the other hand, Bi, which has a melting point lower than that of Pb, is melted during hot working of the brass material and moves to the crystal grain boundaries to cause hot tearing to occur.

In order to ensure free cutting properties using Bi instead of Pb, the Bi content must be 0.5 wt % or more, and is preferably 1.0 wt % or more.

A known Pb-containing brass material has been designed to exhibit desired strength, dezincification resistance, and the like on the assumption that the zinc equivalent of Pb is approximately "1" when using a 60/40 brass material (Cu:Zn=60:40). On the other hand, the invention is based on the finding that the zinc equivalent of Bi is approximately "0".

In a known Pb-containing brass material, Pb is generally added in an amount of 1.0 to 2.0 wt %. In the invention, excellent free cutting properties can be obtained at a Bi content of 0.5 wt % or more. Moreover, a brass material containing Bi in an amount of 0.5 to 2.5 wt % exhibits forgeability and dezincification resistance without substantially subjecting the brass material to a heat treatment after forging (due to combination with Sn described later).

In particular, it was found that excellent forgeability can be obtained and mechanical properties (e.g. elongation and tensile strength) can be improved by adding Bi in an amount of 0.5 to 1.5 wt %.

The chip breakage properties and tool lubricity are improved during cutting by increasing the Bi content. However, since a large amount of Bi moves to the crystal grain boundaries at a high Bi content, the Bi content is preferably limited to 2.5 wt % or less.

The brass material is provided with improved hot forgeability and mechanical properties (e.g. tensile strength) by adding Sn in an amount of 1.5 to 3.0 wt %.

In particular, Sn prevents Bi from moving to the crystal grain boundaries during hot forging.

If the Sn content is less than 1.5 wt %, the effect of addition is insufficient. If the Sn content exceeds 3.0 wt %, the brass material becomes hard and brittle.

Since the brass material tends to become brittle when a large amount of Sn is added, it is preferable to add Sn in an amount of 2.0 wt % or less when adding Bi in an amount of more than 2.0 wt %. On the other hand, Sn may be added in an amount up to 3.0 wt % when adding Bi in an amount of 2.0 wt % or less. In this case, the dezincification resistance of the brass material can be further improved.

In the invention, the forgeability of the brass material is also improved by adding Si.

Si has not been used in a known Cu—Zn—Bi-based brass material since Si embrittles the brass material.

However, it was found that the addition of Si in an amount of 0.05 to 0.30 wt % ensures excellent hot workability during hot forging or the like, particularly at a low temperature, and maintains excellent dezincification resistance.

An improvement of forging properties is not observed when the Si content is less than the lower limit (0.05 wt %). The upper limit (0.30 wt %) is determined taking embrittlement into consideration.

Sb prevents dezincification through the synergistic effect with Sn and P. If the Sb content is less than 0.02 wt %, the effect of addition is not obtained. If the Sb content exceeds 0.10 wt %, the brass material becomes brittle. Therefore, the Sb content is preferably 0.02 to 0.10 wt %.

P also prevents dezincification. If the P content is less than 0.04 wt %, the effect of addition is not obtained. If the P content exceeds 0.15 wt %, P is segregated at the crystal grain boundaries to decrease the ductility of the brass material. Therefore, the P content is preferably 0.04 to 0.15 wt %.

In the invention, the statement "the balance being substantially Zn" means that the brass material may contain other elements such as Fe and Pb as impurities in allowable ranges. Specifically, the brass material may contain other additional trace elements to such an extent that the effects of the invention can be obtained.

The brass material according to the invention exhibits excellent free cutting properties without adding Pb.

Therefore, impact on the environment is reduced by limiting the Pb content to 0.01 wt % or less.

Effects of the Invention

According to the invention, a lead-free free-cutting alloy is provided by adding Bi in an amount of 0.5 to 2.5 wt %. Moreover, a brass material suitably applied to forging and exhibiting relatively low hot resistance is obtained by adding Sn in an amount of 1.5 to 3.0 wt % while setting the Cu content to 61.0 to 63.0 wt % (detailed evaluation results are described later).

In particular, the brass material can be provided with dezincification resistance without substantially subjecting the brass material to a heat treatment after forging.

BRIEF DESCRIPTION OF THE DRAWINGS

FIG. 1 shows chemical compositions of brass materials according to the invention together with comparative examples.

FIG. 2 shows quality evaluation results of brass materials.

FIG. 3 shows a forgeability (upset) test evaluation example.

FIG. 4 shows an evaluation example of dezincification test results.

DETAILED DESCRIPTION OF THE INVENTION

Billets containing various alloy components were cast and hot-extruded to obtain brass materials with a diameter of about 35 mm. FIG. 1 (table) shows the component analysis results of the resulting brass materials.

FIG. 2 (table) shows evaluation results of the brass materials.

(Forgeability)

A specimen with a length (height) of 35 mm was cut from a round rod with a diameter of about 35 mm, and pressure deformed by hot pressing at a specific temperature to evaluate the hot forgeability of the specimen.

The hot forgeability of the specimen was evaluated by occurrence of cracks while changing the upset ratio given below.

$$\text{Upset ratio (\%)}=[(35-h)/35]\times 100 \quad (h\text{: height after pressure deformation})$$

FIG. 2 is a table that shows the forgeability evaluation results (appearance) when changing the upset ratio at a forging temperature of about 750° C. In the table of FIG. 2, "Good" indicates that no cracks occurred, "Fair" indicates that small cracks occurred, and "Bad" indicates that significant cracks occurred.

FIG. 3 shows the appearance evaluation example, in which the upset ratio is indicated on the left and the appearance evaluation example is indicated on the right.

By comparing the materials Nos. 2, 3, and 4, it was found that the elongation value is increased and better forgeability is obtained as the Bi content becomes smaller within the range of 0.5 to 2.5 wt %.

As indicated by the materials Nos. 3, 4, 5 and 9, when the Bi content is 0.5 to 1.5 wt %, it was found that better forgeability and less cracks are obtained even though the upset ratio is 90%.

By the evaluation result of No. 4, it was found that the elongation value is increased up to 23% and the strength of the brass material is increased when comprising 0.5 to 1.0 wt % of Bi, and 1.5 to 2.0 wt % of Sn.

By comparing the materials Nos. 3 and 5, it was found that the strength can be increased by adding Sn while maintaining excellent forgeability, and excellent dezincification resistance is obtained without subjecting the material to a heat treatment after forging.

As indicated by the materials Nos. 6 to 9, the forgeability of the material is also improved by adding Si. Although a needle-like structure was produced and cracks occurred in some cases at a forging temperature of 800° C., cracks did not occur at an appropriate temperature of 750° C. (measurement data is omitted).

(Dezincification test)

The dezincification test was conducted according to the International Standard ISO 6509-1981.

A specimen was cut from a product forged at an upset ratio of 60 to 90% without subjecting the product to a heat treatment, and placed in a phenol resin. The test target surface was then wet-ground.

The test target surface was finished using 5000-grit sandpaper.

The test target surface was caused to contact a 1 wt % copper (II) chloride aqueous solution immediately after preparation at 75° C. for 24 hours.

The specimen was then washed with water and ethanol and dried. The specimen was then cut perpendicularly to the test target surface, and the dezincification depth was measured using an optical microscope.

As the measuring method, an average corroded portion was photographed, and the dezincification depth was measured at 72 points at intervals of 1 mm to determine the maximum dezincification depth and the average dezincification depth.

FIG. 4 shows an evaluation example, in which the depth of the dezincification portion was measured using the microscope.

The materials Nos. 1 to 9 shown in FIG. 1 exhibited excellent dezincification resistance without subjecting the materials to a heat treatment after forging.

Comparative Example 1 is a Pb-containing brass material having a Cu content of more than 63 wt %. As is clear from the result shown in FIG. 2, this material exhibited poor forgeability.

Comparative Example 2 is a Pb-containing brass material having a Cu content of 61 to 63 wt %. This material exhibited poor dezincification resistance in comparison with the Bi-containing alloys having the same Cu content range, P content range, Sn content range, or Sb content range, respectively.

The Pb content was set at a value approximately the same as the Bi content according to the invention. Therefore, it was confirmed that the zinc equivalent of Bi is approximately "0", differing from Pb having a zinc equivalent of approximately "1".

In Comparative Example 3, though the Bi content was a range of the invention, the Cu content was set at less than 61 wt %. The resulting material exhibited poor dezincification resistance.

The brass material according to the invention is a lead-free free-cutting alloy containing Bi which can be suitably applied to forging and exhibits excellent mechanical properties and dezincification resistance without substantially subjecting the brass material to a heat treatment after forging. Therefore, the brass material according to the invention can be applied to materials for various products such as water-related products, and can reduce impact on the environment due to the absence of lead.

What is claimed is:

1. A brass material consisting essentially of 61.0 to 63.0 wt % of Cu, 0.5 to 2.5 wt % of Bi, 1.93 to 3.0 wt % of Sn, 0.02 to 0.10 wt % of Sb, and 0.04 to 0.15 wt % of P, with the balance being substantially Zn, wherein said brass material has an average dezincification depth in a range of 10 to 25 μm without having been subjected to a heat treatment step after hot extrusion and forging.

2. The brass material as defined in claim 1, comprising 0.5 to 1.5 wt % of Bi.

3. The brass material as defined in claim 1, comprising 0.5 to 1.0 wt % of Bi, 1.5 to 2.0 wt % of Sn.

4. The brass material as defined in claim 1, having a Pb content of 0.01 wt % or less.

* * * * *